US006390597B1

(12) United States Patent
Fujimoto et al.

(10) Patent No.: US 6,390,597 B1
(45) Date of Patent: May 21, 2002

(54) INKJET PRINTING HEAD AND INKJET PRINTER

(75) Inventors: Hisayoshi Fujimoto; Toshio Amano, both of Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 08/419,678

(22) Filed: Apr. 12, 1995

(30) Foreign Application Priority Data

Apr. 12, 1994 (JP) ..... 6-073094

(51) Int. Cl.[7] ..... B41J 2/145; B41J 2/15
(52) U.S. Cl. ..... 347/40
(58) Field of Search ..... 347/40, 68, 12, 347/47, 41, 43, 15

(56) References Cited

U.S. PATENT DOCUMENTS 4,812,859 A * 3/1989 Chan et al. ..... 347/43
5,087,930 A * 2/1992 Roy et al. ..... 347/12
5,235,353 A * 8/1993 Hirano et al. ..... 346/145
5,414,453 A * 5/1995 Rhoads et al. ..... 347/8
5,485,183 A * 1/1996 Zandian et al. ..... 347/41

FOREIGN PATENT DOCUMENTS

EP 433556 * 6/1991 ..... B41J/2/21
EP 584823 * 3/1994 ..... 347/47

* cited by examiner

*Primary Examiner*—Thinh Nguyen
(74) *Attorney, Agent, or Firm*—Fish & Richardson P.C.

(57) ABSTRACT

An inkjet printer comprises an inkjet printing head. The printing head has a reduced width in a main scanning direction, is compact, and assures improved printing quality. In the printing head, a head base plate has ink channels and nozzle rows. The ink channels and nozzles are in communication with pressure chambers. The nozzle rows are arranged in an inclined manner along a sub-scanning direction, and are arranged with spaces wider than a printing width in the sub-scanning direction. Different colors of ink are supplied to the ink channels so as to print images in colors such as yellow (Y), magenta (M), cyan (C) or black (BK).

11 Claims, 11 Drawing Sheets

INKJET PRINTING HEAD AND INKJET PRINTER

BACKGROUND OF THE INVENTION

1. Field of the Invention

This invention relates to a printing head for use in a printer, a facsimile machine, a plotter, a word processor and so on, and more particularly to an inkjet printing head.

2. Description of the Related Art

A number of inkjet printers using inkjet printing heads have been in wide use. In such a printer, the inkjet printing head emits a steady stream of ink drops onto a printing medium without coming into contact with the medium. The inkjet printer does not require the printing medium such as paper whose quality is strictly technically controlled, and is advantageous in that it can assure high quality printing.

An example of the inkjet printing head comprises piezoelectric elements, a plurality of nozzles, pressure chambers, and a thin diaphragm. The nozzles are in communication with the pressure chambers as temporary ink retainers. The pressure chambers are open at their upper portions. The diaphragm made from glass or resin covers the open portions of the pressure chambers. The piezoelectric elements are disposed on the diaphragm in such a manner as to correspond to the pressure chambers on a one-to-one basis. To emit ink via the nozzles, a voltage is applied to piezoelectric elements. The piezoelectric elements are flexed, thereby causing associated portions of the diaphragm to be flexed too. The capacity of the pressure chambers is reduced so as to emit ink via nozzles. When the voltage is interrupted, the piezoelectric elements and the diaphragm return to their normal state. Thereafter, the pressure chambers suck in ink from ink supplies, thereby preparing for succeeding ink emission.

Bubble jet printers have also been popular. In this type of printer, ink is heated by a heater. The heated ink generates bubbles, so that ink is emitted in drops utilizing a vapor pressure of the bubbles. The bubble jet printer does not require large pressure chambers compared with the inkjet printer which uses piezoelectric elements to change the capacity of the pressure chambers, and is advantageous in that nozzles can be integrated in a very closely packed manner.

A printing head for a color printer will be described hereinafter. Assume that a bubble jet printer comprises an inkjet printing head 100 as shown in FIG. 1. The inkjet printing head 100 includes a plurality of nozzle rows 102, each of which has a plurality of nozzles 101. The nozzles 101 are aligned in a sub-scanning direction in which a printing medium such as paper, not shown, is moved. Referring to FIG. 1, four nozzle rows 102 are juxtaposed in a main scanning direction in which the inkjet printing head 100 moves. The nozzles in the four rows 102 emit ink of different colors such as yellow (Y), magenta (M), cyan (C) and black (BK) colors, respectively. These four colors are overlaid so as to produce printed images in a variety of colors.

FIG. 2 shows the arrangement of nozzles used for an inkjet printing head 200 of the bubble jet printer or an inkjet printer including piezoelectric elements. The inkjet printing head 200 has a nozzle row 103 constituted by a plurality of nozzles 101. The nozzle row 103 is inclined in both the sub- and main scanning directions, and is divided into four blocks a–d. The nozzles 101 in these blocks a–d emit different colors (Y, M, C and BK), respectively, so as to produce an image having various colors.

Quick drying ink should be used when the color printing is performed by arranging the nozzle rows 102 and nozzle blocks a–d in the main scanning direction. This is because ink of a first color is emitted, and ink of a second color is emitted immediately after the first one, and these two colors will be overlaid. In such a case, ink containing a penetrant is used so as to penetrate into the sheet and become dry quickly.

With the inkjet printing head using the piezoelectric elements, it is very difficult to arrange nozzles in a packed manner as with the bubble jet printing head. As shown in FIG. 2, the nozzles 101 are inclined in the sub-scanning direction so as to improve dot pitches. However, this inevitably enlarges the inkjet printing head in the main scanning direction. It is impossible to make the inkjet printing head compact. Further, when it becomes large in the main scanning direction, the inkjet printing head takes a long time to scan, in the main scanning direction, i.e. a space which is longer than a printing line.

Although it can reduce a space for the nozzles, the bubble jet system has to heat ink to about 400° C. It is necessary to prevent the ink from being burnt. Therefore, kinds of usable ink are very limited, and printing quality remain to be improved. Although oil based ink offering good printing quality is available, it cannot be used for the bubble jet printer.

Further, since a vapor pressure of heated ink is used to emit ink, it is not possible to vary the sizes of ink drops easily. This means that it is impossible to gradate printed images by fine-controlling the size of ink drops.

Ink containing a penetrant can shorten a drying period but blurs printed images, which will result in poor printing quality.

SUMMARY OF THE INVENTION

The invention is aimed at providing an inkjet printing head for color printing which has a reduced width in a main scanning direction, is compact in size, and assures improved printing quality.

According to a preferred embodiment, there is provided an inkjet printing head in which piezoelectric elements are flexed by a drive voltage applied thereto and cause a diaphragm, where the piezoelectric elements are disposed, to shudder so as to eject ink via nozzles. The inkjet printing head comprising: (a) a plurality of nozzles arranged in a plurality of rows on a head base plate, each of the nozzle rows being arranged in an inclined manner along a sub-scanning direction where a printing medium is moved, and being spaced from an adjacent nozzle row by a distance which is larger than a printing width; and (b) a plurality of pressure chambers disposed on the head base plate, the pressure chambers being in communication with the nozzles, changing their capacity in response to shudders of the diaphragm, and being arranged in two rows in the sub-scanning direction, in the vicinity of each nozzle row.

With the foregoing arrangement, a plurality of nozzle rows are disposed on the head base plate. A printer including this inkjet printing head prints images in colors by ejecting different colors of ink via nozzle rows. The nozzle rows are arranged in an inclined manner along the sub-scanning direction, which prevents the printing head from becoming wider in the main scanning direction. Thus, the inkjet printing head can be made compact. Since the printing head is small in the main scanning direction, it is not required to move unnecessarily in the main scanning direction.

The nozzles are arranged in an inclined manner along the sub-scanning direction, which increases dot density.

The pressure chambers in communication with the nozzles are arranged in two rows in the sub-scanning direction, in the vicinity of the nozzle rows. It is possible to reduce a nozzle pitch in the sub-scanning direction. This two-row arrangement of the pressure chambers can reduce the head width in the main scanning direction.

The nozzle rows are spaced apart by a distance which is larger than a printing width which is covered by one nozzle row. Thus, ink channels and pressure chambers can have sufficient widths in the sub-scanning direction. Further, the piezoelectric elements have sufficient length. Ink can therefore be supplied to the pressure chambers without any difficulty. The ink can be powerfully ejected via the nozzle, so that a printed image has good quality. The nozzle rows are arranged with sufficient space therebetween, so that there is sufficient time from printing in one color till printing in another color, during which ink can be dried completely. Therefore, no penetrant is required. It is possible to offer printed images without blurred portions.

DESCRIPTION OF THE PREFERRED EMBODIMENT

Figure 1:
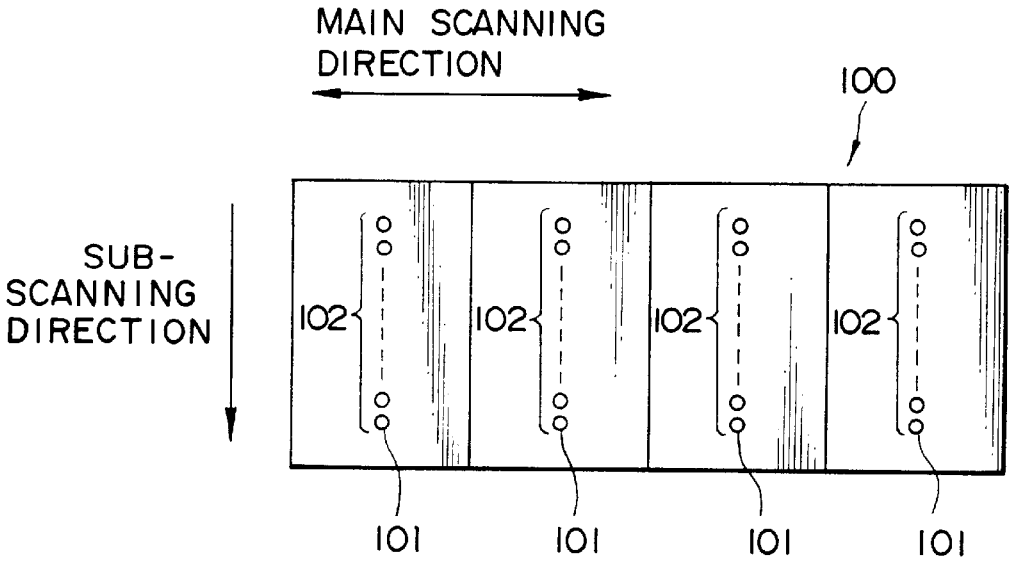
FIG. 1 is a plan view showing the configuration of an inkjet printing head.
Figure 2:
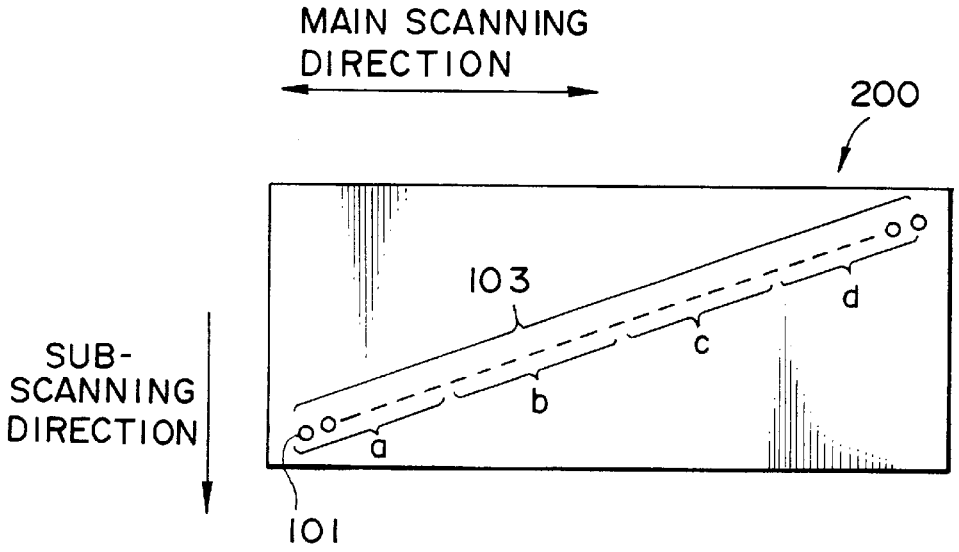
FIG. 2 is a plan view showing the configuration of another inkjet printing head.
Figure 3:
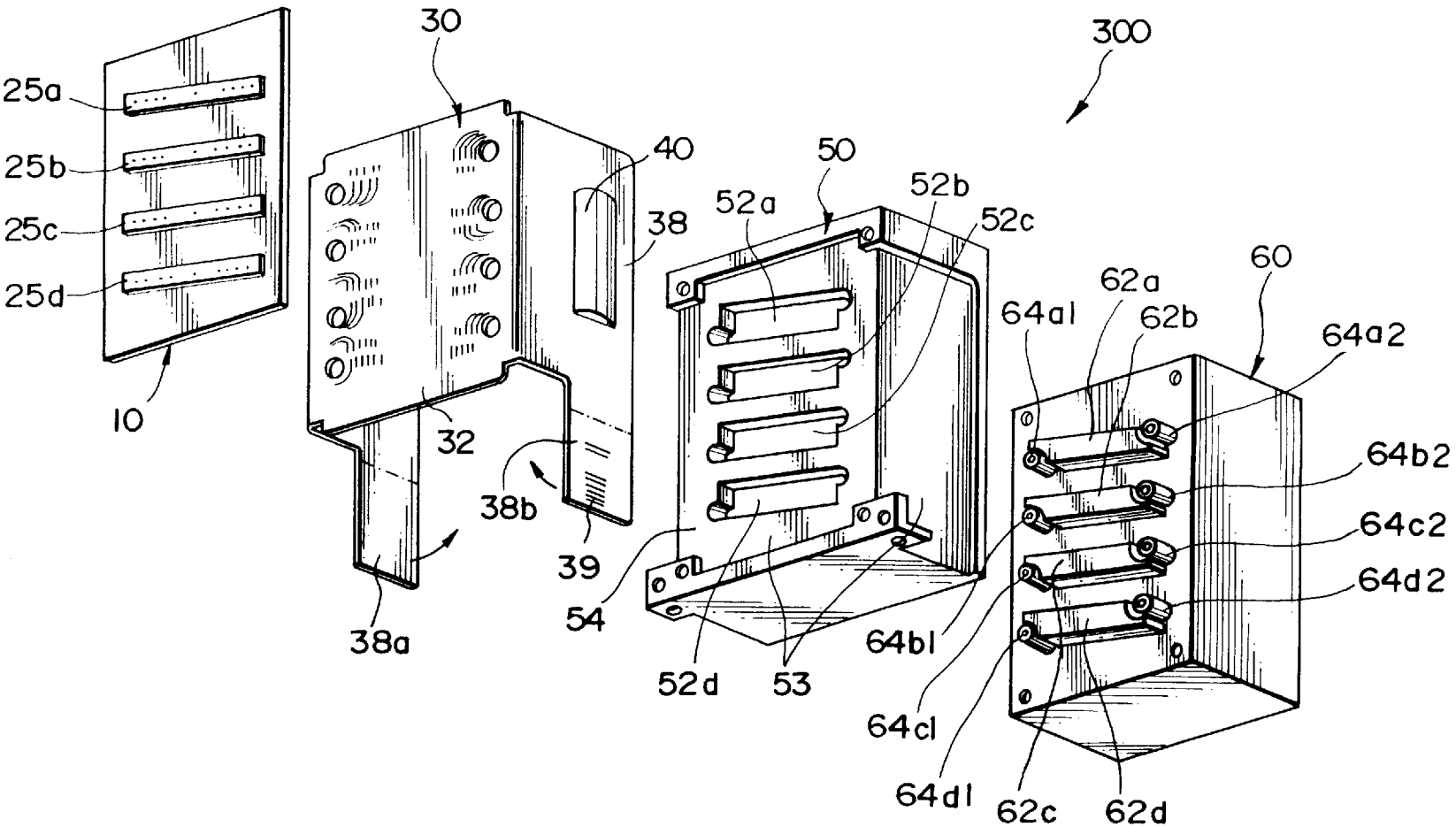
FIG. 3 is an exploded perspective view showing the structure of an inkjet printing head according to an embodiment of the present invention.
Figure 4:
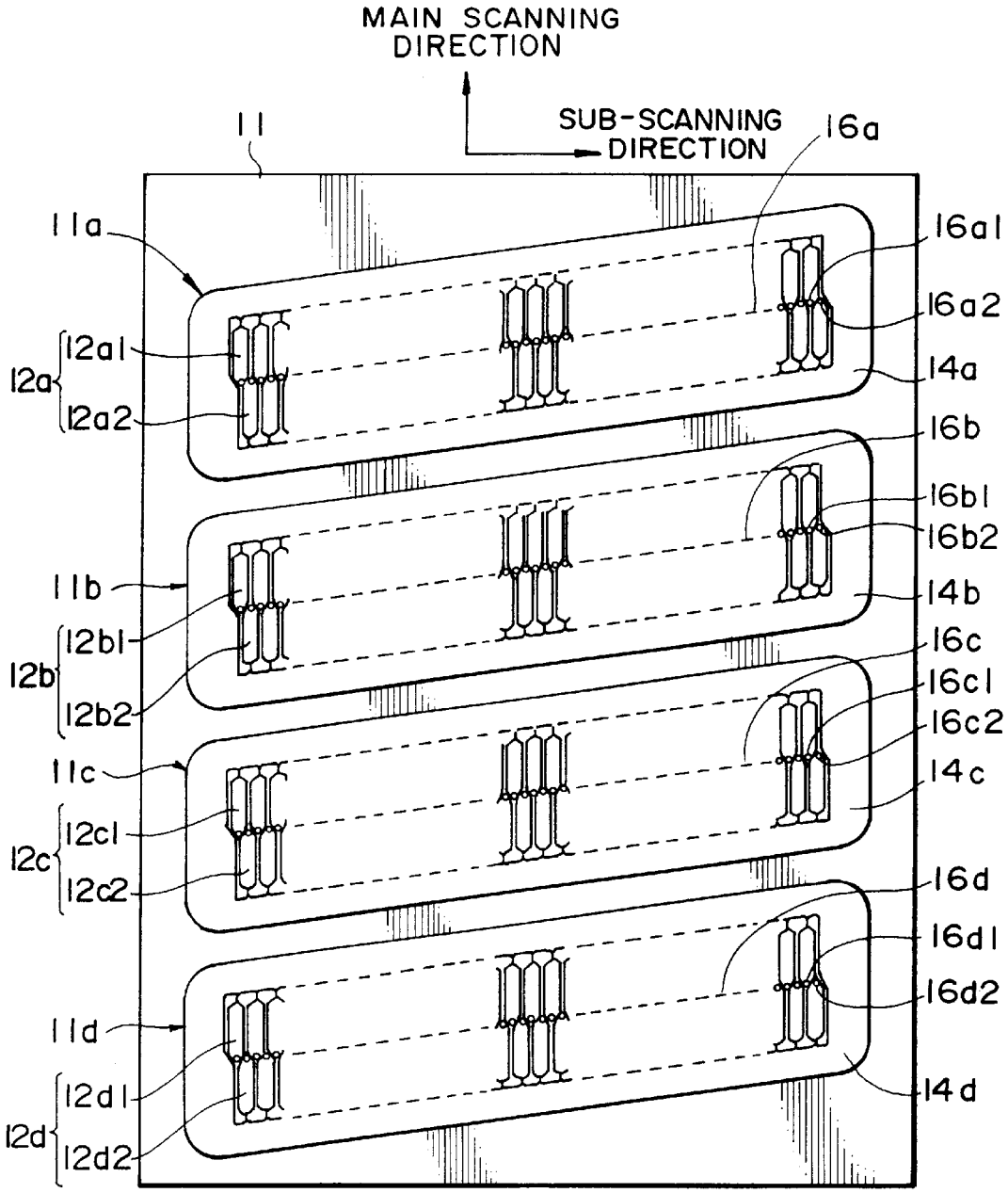
FIG. 4 is a plan view showing the configuration of a head base plate.

Referring to FIG. 3, an inkjet printing head 300 according to the invention comprises a base plate unit 10, a flexible cable 30, a first frame 50 and a second frame 60. The base plate unit 10 includes a head base plate 11 (shown in FIG. 4) and a diaphragm 20 (shown in FIG. 6). The head base plate 11 is made from glass or resin, and has ink channels 11*a*–11*d* in the shape of a trough as shown in FIG. 4. The ink channels 11*a*–11*d* convey ink of different colors: e.g. the ink channel 11*a* receives yellow (Y) ink; the ink channel 11*b* receives magenta (M) ink; the ink channel 11*c* receives cyan (C); and the ink channel lid receives black (BK) ink. The head base plate 11 is 56.7 mm long and 44.5 mm wide, for example.

All the ink channels 11*a*–11*d* have the same shape, so that the ink channel 11*a* will be described as a typical example. The ink channel 11*a* slopes slightly upwardly towards the right in the main scanning direction in which the inkjet printing head 300 moves. The pressure chamber unit 12*a* is present on the ink channel 11*a*, and also slope upwardly towards the right. The pressure chamber unit 12*a* includes upper and lower groups of pressure chambers 12*a*1 and 12*a*2, along a row of nozzles (to be described later). Each of the upper and lower groups of pressure chambers 12*a*1 and 12*a*2 is constituted by 30 pressure chambers. The pressure chambers in the upper and lower groups 12*a*1 and 12*a*2 are arranged in a staggered manner. The upper and lower pressure chamber groups 12*a*1 and 12*a*2 are arranged in two rows in the sub-scanning direction of the inkjet printing head 300. Even if the nozzle pitch is reduced in the main scanning direction, it is possible to dispose the pressure chambers. This two-row arrangement of the pressure chambers enables to reduce the width of the printing head 300 in the main scanning direction.

Figure 5A:
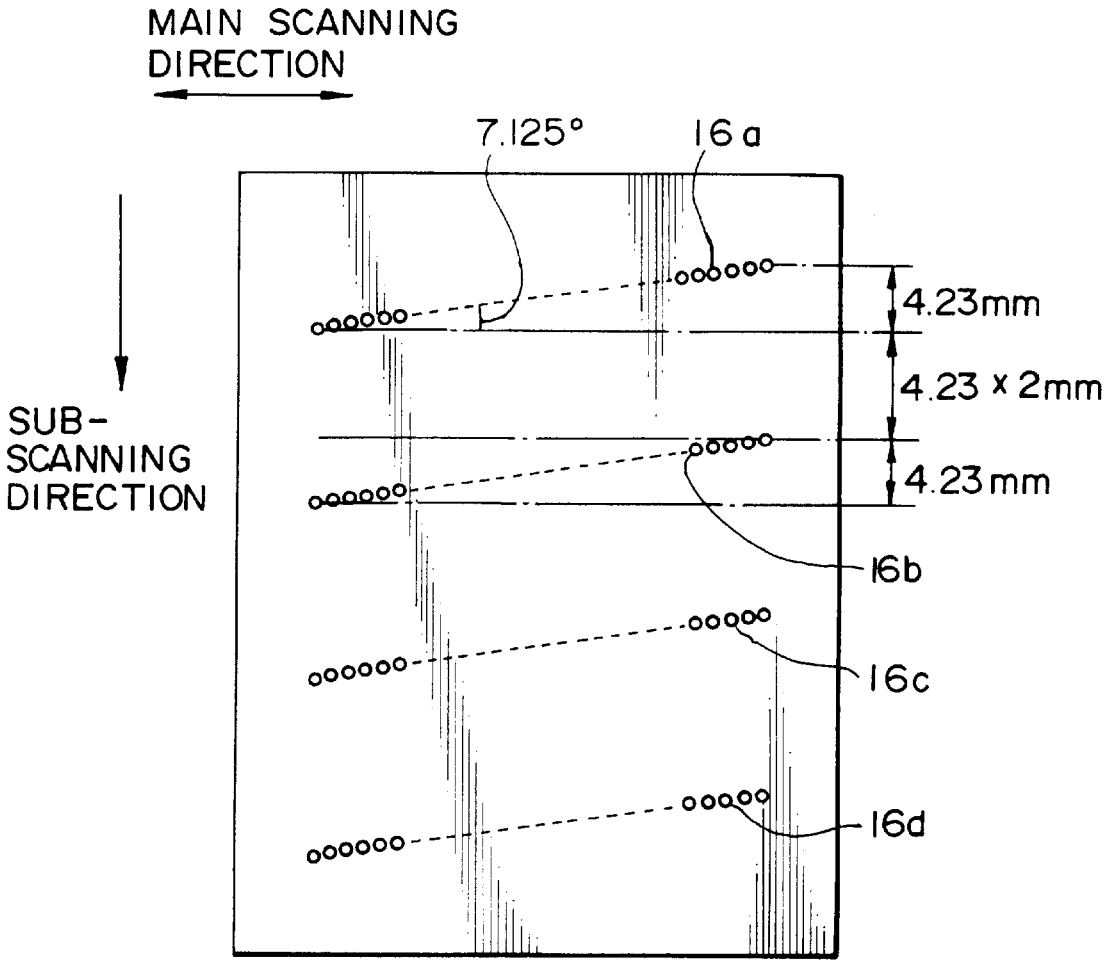
FIG. 5A shows the arrangement of nozzle rows on the head base plate.

A plurality of nozzles 16*a*1 and 16*a*2 arranged in a row are positioned between the two rows of the pressure chamber group 12*a*. Each of the nozzles 16*a*1 corresponds to one of the pressure chambers 12*a*1, and each of nozzles 16*a*2 corresponds to one of pressure chambers 12*a*2. Each nozzle communicates with one end of its respective pressure chamber. Each pair of the nozzle 16*a*1 and the pressure chamber 12*a*1 and each pair of the nozzle 16*a*2 and the pressure chamber 12*a*2 are alternately arranged on the head base plate. A total of 60 nozzles are provided in this embodiment. The nozzles 16*a*1 and 16*a*2 slope upwardly towards the right similarly to the pressure chamber group 12*a*. A printing width of the nozzle row 16*a* is 4.23 mm in the sub-scanning direction (in which the sheet moves during the printing process) as shown in FIG. 5A. A clearance between two adjacent nozzle rows 16*a* and 16*b* is greater than the foregoing printing width 4.23 mm, e.g. 8.46 mm (=4.23×2). The nozzle row 16*a* is inclined by 82.875° with respect to the sub-scanning direction (i.e. 7.125° with respect to the main scanning direction). The nozzle rows 16*a*–16*d* are inclined with respect to the sub-scanning direction such that a nozzle pitch can be reduced in the sub-scanning direction. This allows dots to be arranged with an increased density so as to improve printing quality.

Figure 5B:
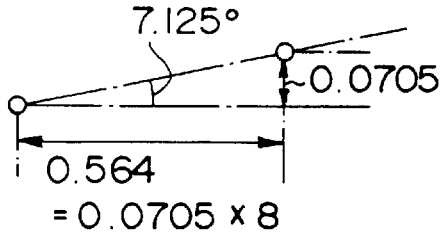
FIG. 5B shows the relationship between two adjacent nozzles of FIG. 5A.

Referring to FIG. 5B, the nozzles are positioned apart by a space of 0.564 mm in the main scanning direction and a space of 0.0705 mm in the sub-scanning direction. The space of 0.0705 mm in the sub-scanning direction is for the standard 360 DPI (dots per inch).

A plurality of nozzle rows are disposed along the sub-scanning direction so as to prevent the printing head from becoming large in the main scanning direction. Therefore, the inkjet printing head can be down-sized overall. Further, the printing time can be reduced since the printing head 300 does not move extensively in the main scanning direction.

Further, the nozzle rows 16*a* and 16*b* are arranged with a space which is larger than the printing width along the sub-scanning direction. This arrangement enables ink channels and pressure chambers to have sufficient widths in the sub-scanning direction, so they can easily supply ink to the pressure chambers. Besides, the piezoelectric elements can have a sufficient length. Thus, the pressure chambers can eject the ink with sufficient pressure. All of these factors contribute to improvement of the printing quality.

In addition, the nozzle rows are arranged with sufficient spaces therebetween, so that there is enough time for one printing operation using a certain color to dry a printed image before another printing operation using a different color. Thus, it is not necessary to use a penetrant, which prevents the printed images from being blurred.

When the adjacent nozzle rows 16*a* and 16*b* are arranged apart by a distance which is an integer-times the printing width, it is easy to control printing data. If the adjacent nozzle rows are arranged with a space which is non-integer times the printing width such as 2.3 or 3.5 times. Ink can be easily supplied to the pressure chambers, which can eject ink with a sufficient pressure.

Returning to FIG. 4, a common ink path 14*a* surrounds the pressure chamber group 12*a* so as to distribute the ink (supplied from ink supplies, not shown) to the pressure chambers 12*a*1 and 12*a*2.

As shown in FIG. 3, nozzle plates 25*a*–25*d* are attached on an ink ejecting side of the base plate unit 10. The nozzle plates 25*a*–25*d* are made from a water-repellent material, and a diameter of the nozzles is precisely regulated. Thus, the nozzles can effectively eject ink drops whose size and shape are accurately controlled.

Figure 6:
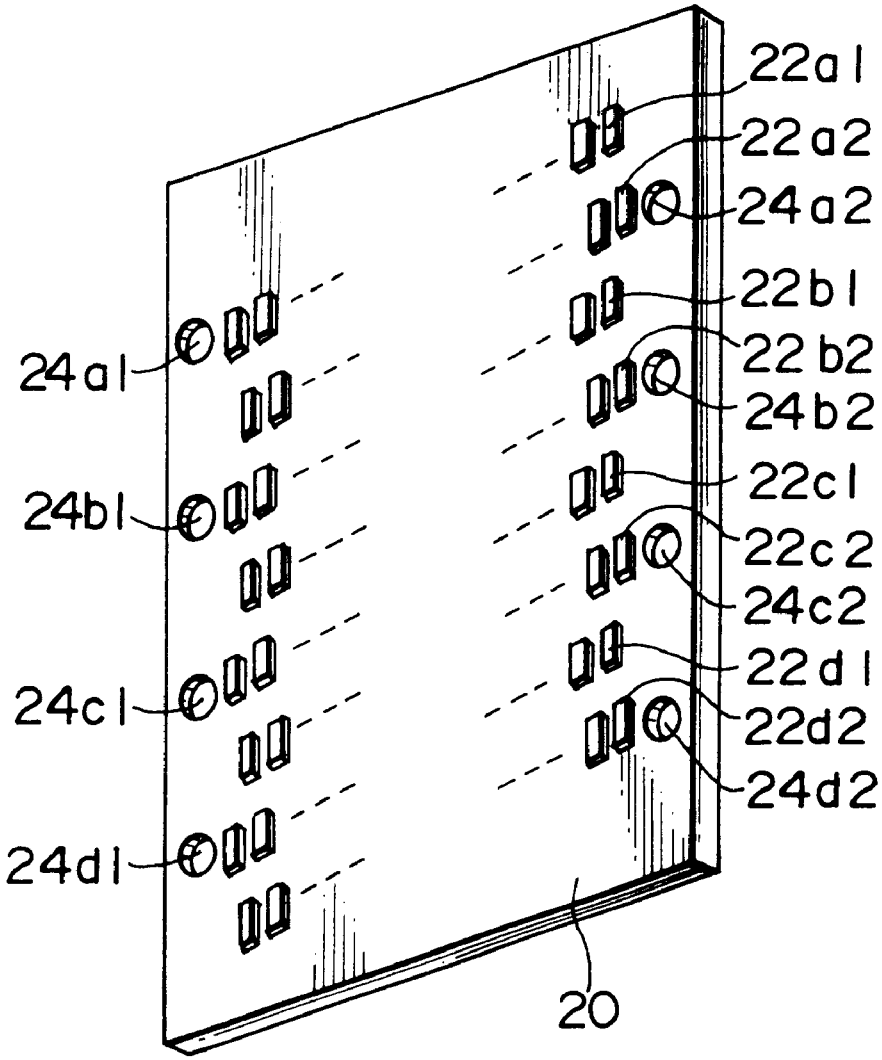
FIG. 6 is a perspective view showing the configuration of a diaphragm in a base plate.
Figure 7:
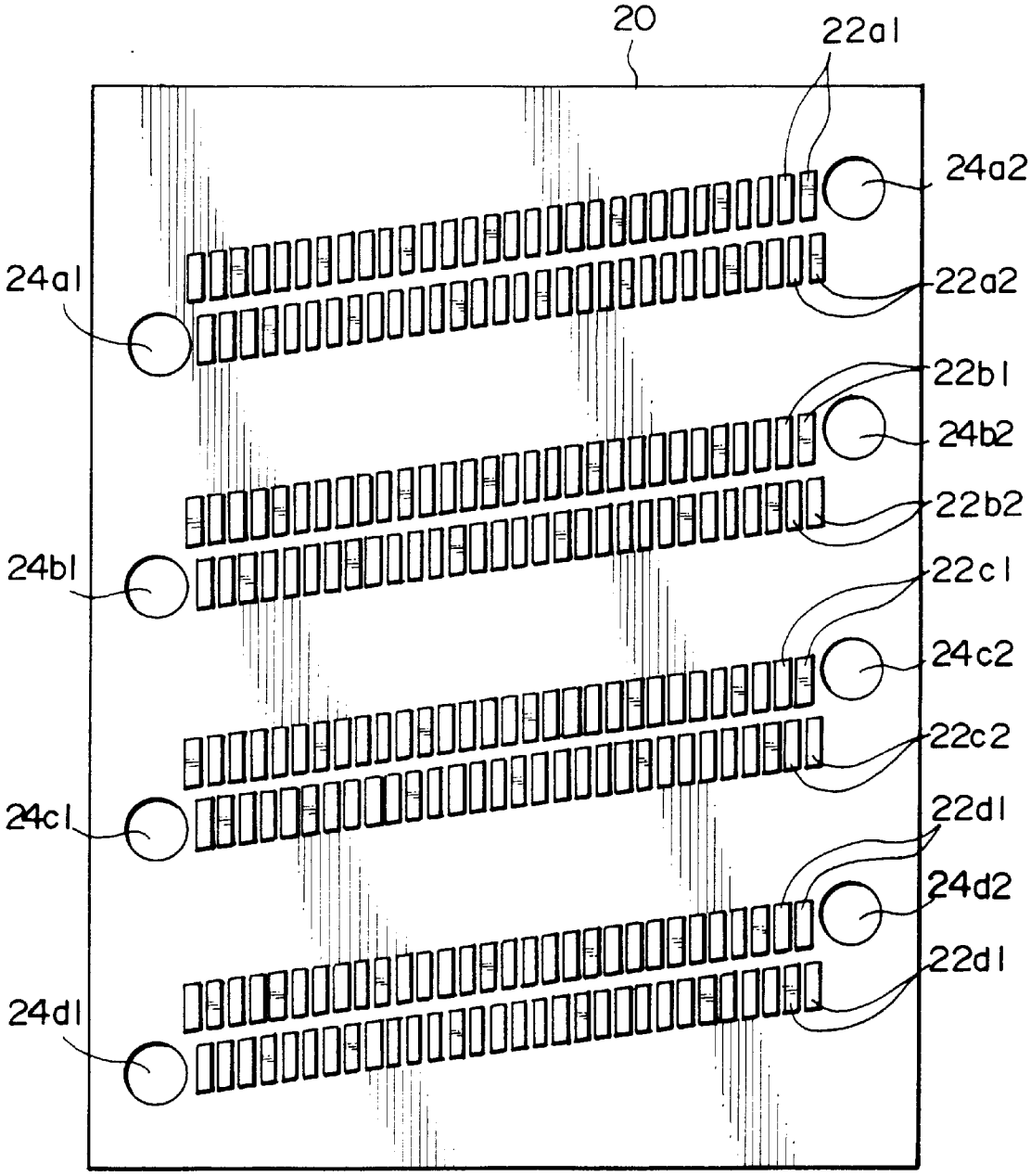
FIG. 7 is a plan view showing the configuration of the diaphragm.

Referring to FIGS. 6 and 7, the diaphragm 20 is made from a rectangular glass or resin plate similarly to the head base plate 11. The diaphragm 20 is covered, on one surface, by a conductive film made from a material such as ITO (indium tin oxide) or Cr. The piezoelectric elements 22*a*1–22*d*1 (i.e. 22*a*1 and 22*a*2, 22*b*1 and 22*b*2, 22*c*1 and 22*c*2, and 22*d*1 and 22*d*2) are attached on the conductive film of the diaphragm 20. These piezoelectric elements 22*a*1–22*d*2 are located at positions corresponding to the pressure chambers 12*a*–12*d* on the head base plate 11. Further, the diaphragm 20 has two rows of openings 24*a*1–24*d*1 and 24*a*2–24*d*2 along the opposite side edges thereof, respectively as shown in FIG. 6. The diaphragm 20 is coupled to the surface of the head base plate 11 where the ink channels are provided.

The flexible cable 30 is in the shape of a trough, and has a flat portion 32 and a pair of sides 38 shown in FIG. 3. The sides 38 have downward extension 38*a* and 38*b* from the sides 38. The flexible cable 30 includes a pair of driver ICs 40 on the sides 38 thereof. The extensions 38*a* and 38*b* have electrodes 39 for connection with a power body. The driver ICs 40 collectively control the piezoelectric elements 22*a*1–22*d*2 which are connected to electrodes or the flexible cable 30.

Figure 8:
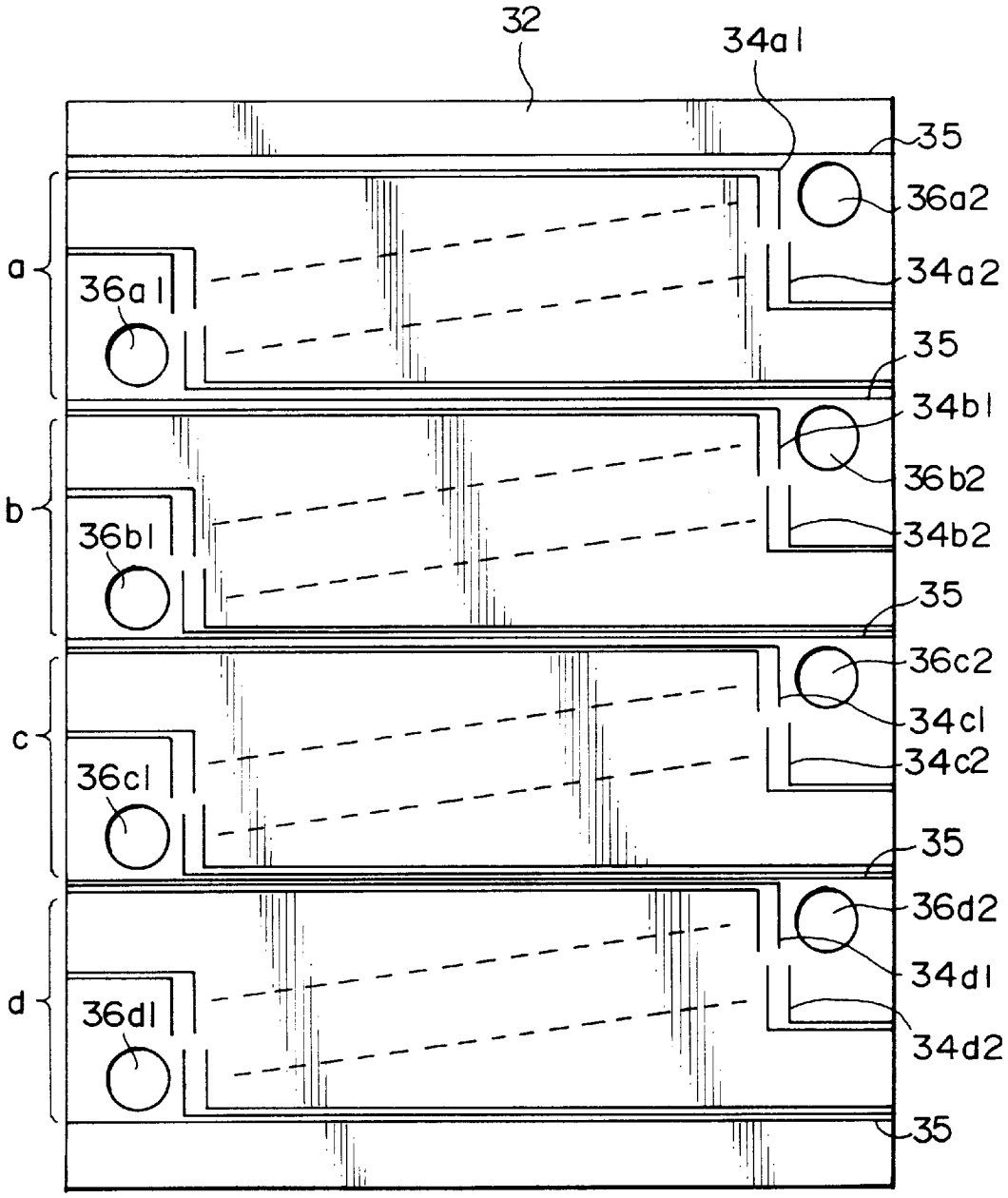
FIG. 8 is plan view showing the configuration of a flexible cable.

The flat portion 32 of the flexible cable 30 is patterned to form four blocks a to d as shown in FIG. 8. Five electrode lines 35 are disposed between the blocks a to d and near the top and bottom of the flexible cable 30.

Since the blocks a to d are identically configured, only the block a will be described hereinafter as a typical example.

The block a has electrodes 34*a*1 and 34*a*2 discretely corresponding to the piezoelectric elements 22*a*1 and 22*a*2. The electrodes 34*a*1 and 34*a*2 are called "discrete electrodes 34*a*1 and 34*a*2 " hereinafter. A lead wire extending from the upper left corner of the block a is connected to the discrete electrode 34*a*1, which corresponds to the piezoelectric element 22*a*1 (refer to FIGS. 6 and 7). A lead wire extending from the lower right corner of the block a is connected to the discrete electrode 34*a*2, which corresponds to the piezoelectric element 22*a*2. Even when the number of nozzles in each nozzle row is increased, the nozzles can be easily connected to their discrete electrodes. This is because the lead wires are disposed along the right and left side edges of the flexible cable 30 as described above. Further, the discrete electrodes can be effectively connected to the driver ICs via the lead wires, so that a drive voltage can be effectively supplied to the piezoelectric elements. An opening 36*a*1 is present at the lower left corner of the block a, and corresponds to the opening 24*a*1 on the diaphragm 20. Further, there is an opening 36*a*2 at the upper right corner of the block a, which corresponds to the opening 24*a*2 on the diaphragm.

It is conceivable to connect both of the discrete electrodes 34*a*1 and 34*a*2 to lead wires which are present at one side edge of the flat portion 32 of the flexible cable 30. However, since such an arrangement inevitably widens the flexible cable 30 in the sub-scanning direction, the discrete electrodes 34*a*1 and 34*a*2 are connected to the lead wires which are present along the opposite side edges of the flexible cable 30. Depending upon the positions of the openings 24*a*1 and so on, it is conceivable to position the lead wires for the discrete electrodes 34*a*1, 34*b*2, 34*c*1 and 34*d*2 along the left side edge of the flexible cable 30, and to position the lead wires for the discrete electrodes 34*a*2, 34*b*1, 34*c*2 and 34*d*1 along the right side edge, i.e. to connect the discrete electrodes to the lead wires in a staggered manner. The five electrode lines 35 on the flat surface 32 of the flexible cable 30 serve as reinforcing electrodes so as to suppress a voltage drop in the voltage across the conductive film on the diaphragm 20. Alternatively, a tab may be used in place of the flexible cable 30.

The first frame 50 is structured so as to house the second frame 60 therein as shown in FIG. 3. The first frame 50 has windows 52*a*–52*d*, through which elastic members 62*a*–62*d* and ink pipes 64*a*1–64*d*2 of the second frame 60 extend. The elastic members 62*a*–62*d* and ink pipes 64*a*1–64*a*2 will be described later.

Further, the first frame 50 also supports the flexible cable 30. The first frame 50 has a recess 53 for supporting the flexible cable 30 therein. The recess 53 has a depth which is equal to a thickness of the flexible cable 30. In the first frame 50, a side 54 serves to press the flexible cable 30 toward the base plate unit 10. In other words, the flexible cable 30 and the diaphragm 20 are in intimate contact with each other except for the portions corresponding to the piezoelectric elements, thereby preventing generation of unnecessary vibrations and noise. The side 54 of the first frame 50 fixes the flexible cable 30 and the diaphragm 20 tightly. Thus, it is possible to reduce unnecessary vibrations, and to improve the printing quality.

Referring to FIG. 3, the second frame 60 is substantially a rectangular parallelpiped, and includes the elastic members 62*a*–62*d* made from sponge or rubber, and ink pipes 64*a*1–64*d*2 for supplying the ink to the head base plate 11. With the second frame 60, the elastic members 62*a*–62*d* and ink pipes 64*a*1–64*d*2 are located on a side to which the base plate unit 10 is attached. The elastic members 62*a*–62*d* are in contact with the discrete electrodes on the flexible cable 30. The discrete electrodes 34*a*1–34*d*2 on the flexible cable 30 are pressed so as to be reliably brought into contact with the piezoelectric elements 22*a*1–22*d*2 on the diaphragm 20. The elastic members 62*a*–62*d* serve to prevent generation of unnecessary shudders or noise due to resonance when the piezoelectric elements are operated. The ink pipes 64*a*1–64*d*2 pass through the openings 36*a*1–36*d*2 on the flexible cable 30, and, at one end thereof, come into contact with the openings 24*a*1–24*d*2 on the diaphragm 20.

The second frame 60 houses four ink reservoirs. One pair each of the ink pipes 64*a*1–64*d*2 are provided for four colors of ink, i.e. 64*a*1 and 64*a*2, 64*b*1 and 64*b*2, 64*c*1 and 64*c*2, and 64*d*1 and 64*d*2. This is because the pressure chambers 12*a*–12*d* are arranged in two rows, respectively, as shown in FIG. 4, thereby reducing resistances applied to the ink through the ink channels and making it possible to supply the ink reliably. Further, a plurality of routes are used to supply the ink reliably even when the number of pressure chambers is increased or when rows of the pressure chambers are lengthened.

Figure 9:
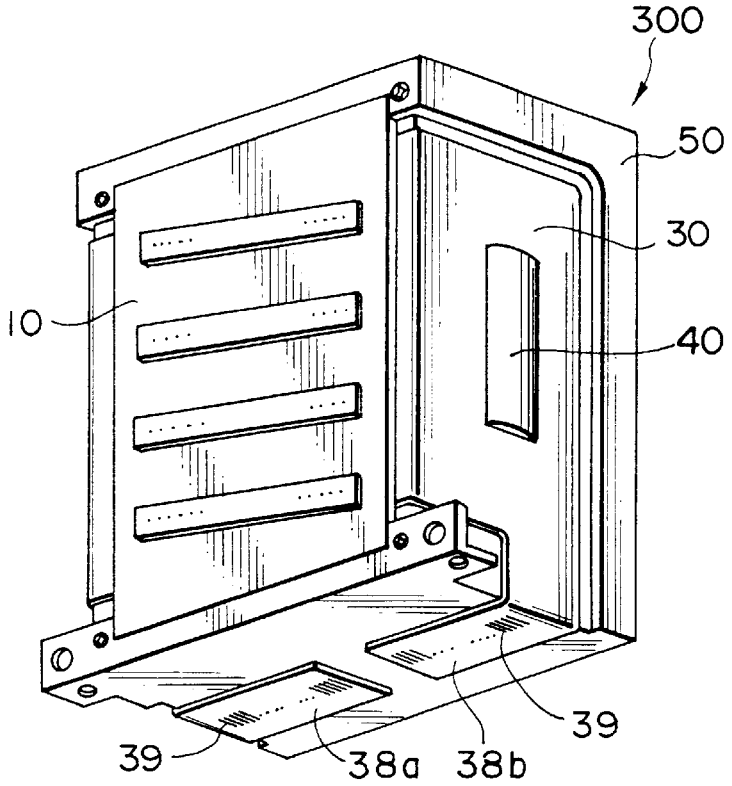
FIG. 9 is a perspective view showing the external appearance of the inkjet printing head.

FIG. 9 is a perspective view showing an assembled state of the base plate unit 10, flexible cable 30, and first and second frames 50 and 60. It can be seen that the extensions 38*a* and 38*b* of the flexible cable 30 are folded along the bottom of the first frame 50, and the electrodes 39 face downward.

Figure 10:
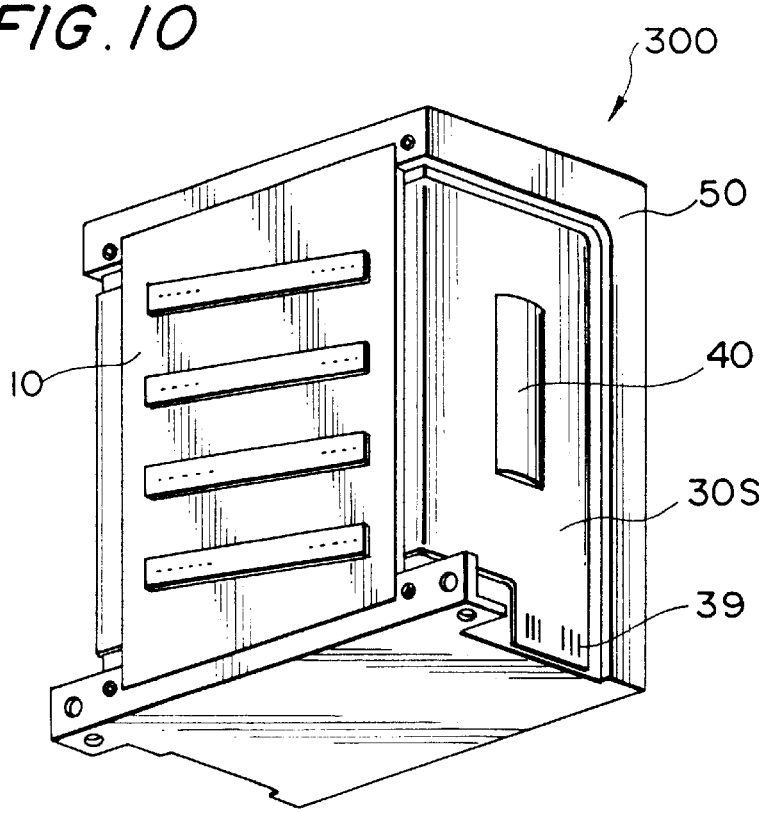
FIG. 10 is a perspective view showing the external appearance of the modified inkjet printing head.

Another type of the flexible cable 30*s* is shown in FIG. 10. In this example, the electrodes 39 (only one is shown in FIG. 10) are in contact with sides of the first frame 50.

Figure 11:
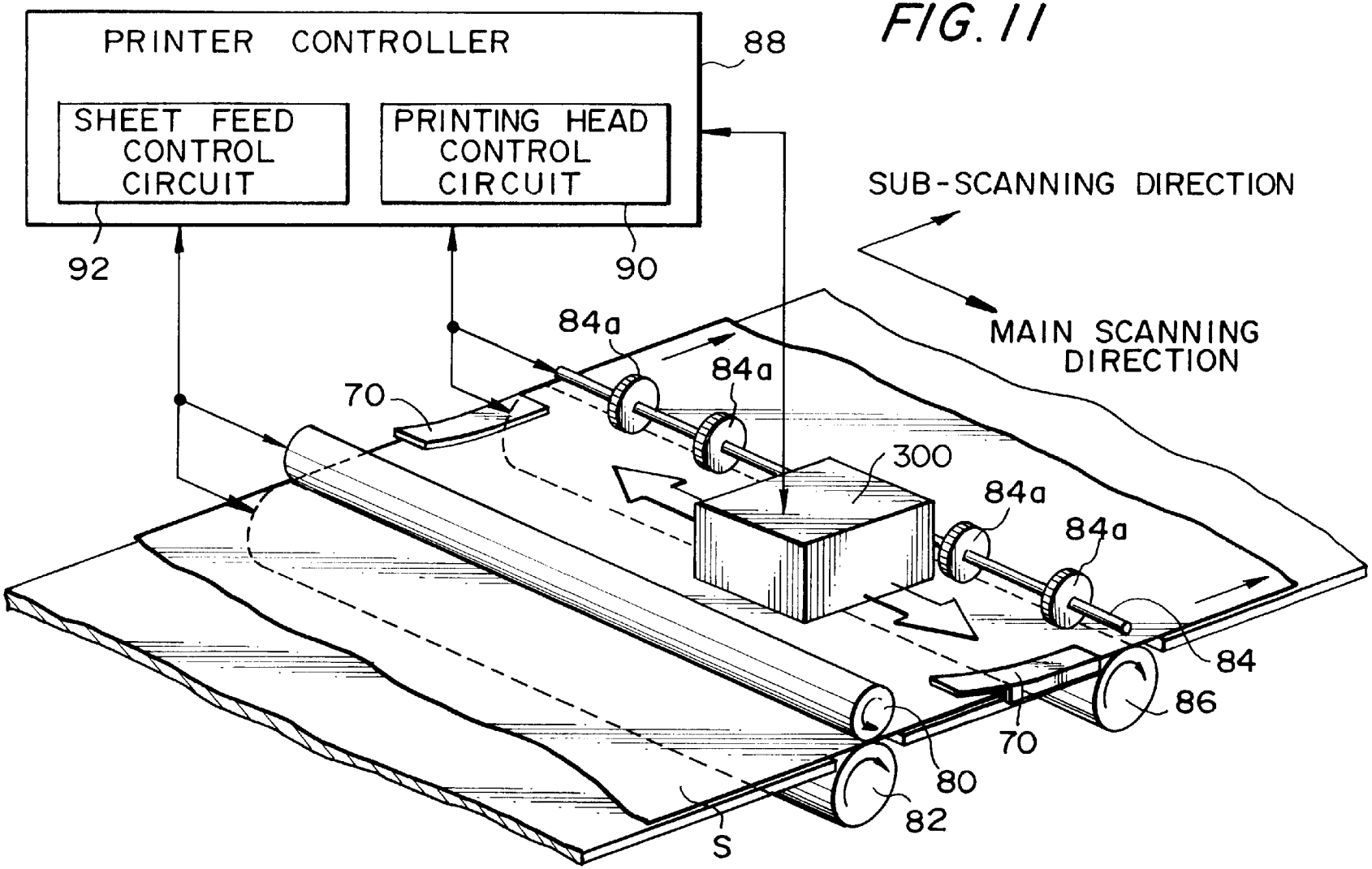
FIG. 11 is a schematic view showing a main part of an inkjet printer using the inkjet printing head of the present invention.
Figure 12:
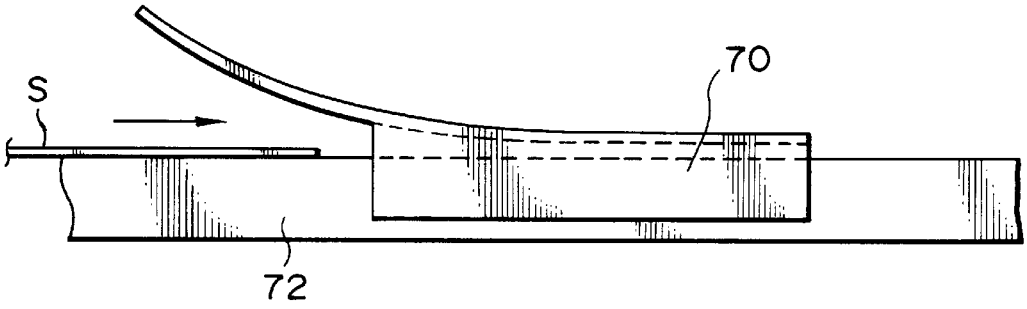
FIG. 12 is a view of one of printing medium holders.

Referring to FIG. 11, a printer including the inkjet printing head 300 will be described. A pair of sheet holders 70 are disposed partially along opposite side edges of a sheet (as a printing medium) in the main scanning direction, and function to hold the sheet S so that it is not raised from a sheet feeding surface 72. The sheet holders 70 are made from a thin metal or resin plate, and have smooth surfaces. As shown in FIG. 12, the sheet holders 70 have upwardly curled portions toward a leading edge of the sheet S so as to reliably guide the sheet S toward a printing position. Each of the sheet holders 70 may have a desired width in the main scanning direction. However, if they are too wide in this direction, a printable area may be narrowed on the sheet S. Therefore, the sheet holders 70 should be as thin as possible so long as they can reliably hold the sheet S. Further, if the sheet holders 70 have a height which the inkjet printing head 300 can pass over, the sheet can be printed even on margins except for where the sheet holders 70 are present.

A pair of rollers 80 and 82 and a pair of roller 84 and 86 are disposed in the sub-scanning direction of the inkjet printing head 300. The pair of rollers 84 and 86 are positioned downstream of the rollers 80 and 82. The rollers 80 and 82 take in the sheet S while the rollers 84 and 86 take out the sheet S. The roller 84 is in contact with a printed surface of the sheet S, and includes a plurality of split and knurled roller members 84*a* so as to come into contact with the printed sheet at reduced areas. Therefore, even when ink is not sufficiently dried, the rollers 84*a* do not make the printed surface faint and patchy. This means the printer can improve the printing quality.

In the example shown in FIG. 11, the sheet holders 70 only partially hold the opposite side edges of the sheet. Alternatively, the sheet holders 70 may hold any portions of the sheet so long as they do not disturb the movement of the inkjet printing head 300.

The operation of the printer including the inkjet printing head 300 will be described hereinafter. The second frame 60 houses the four ink reservoirs (not shown) therein. The ink reservoirs respectively house yellow (Y) ink, magenta (M) ink, cyan (C) ink and black (BK) ink. The four colors of ink are respectively supplied to the ink channels 11*a*–11*d* on the head base plate 11. The printer controller 88 provides printing data to the driver ICs 40 of the inkjet printing head 300 via a printing head control circuit 90. In accordance with the printing data, the driver ICs 40 apply a drive voltage to specified piezoelectric elements so as to flex them. Then, the piezoelectric elements flex the diaphragm 20 at portions associated with them. Thereafter, pressure chambers are caused to vary their capacity, thereby ejecting ink via nozzles so as to print a color image. The printing head 300 moves in the main scanning direction and performs printing during its back-and-forth motion. The sheet S whose opposite side edges are held by the sheet holders 70 is paid out at a predetermined pitch in the sub-scanning direction. A sheet feed control circuit 92 in the printer controller 88 controls sheet feeding. Specifically, the sheet feed control circuit 92 drives the pair of rollers 80 and 82 and the pair of rollers 84 and 86 at predetermined pitches so that the sheet S is conveyed by these rollers.

Figure 13:
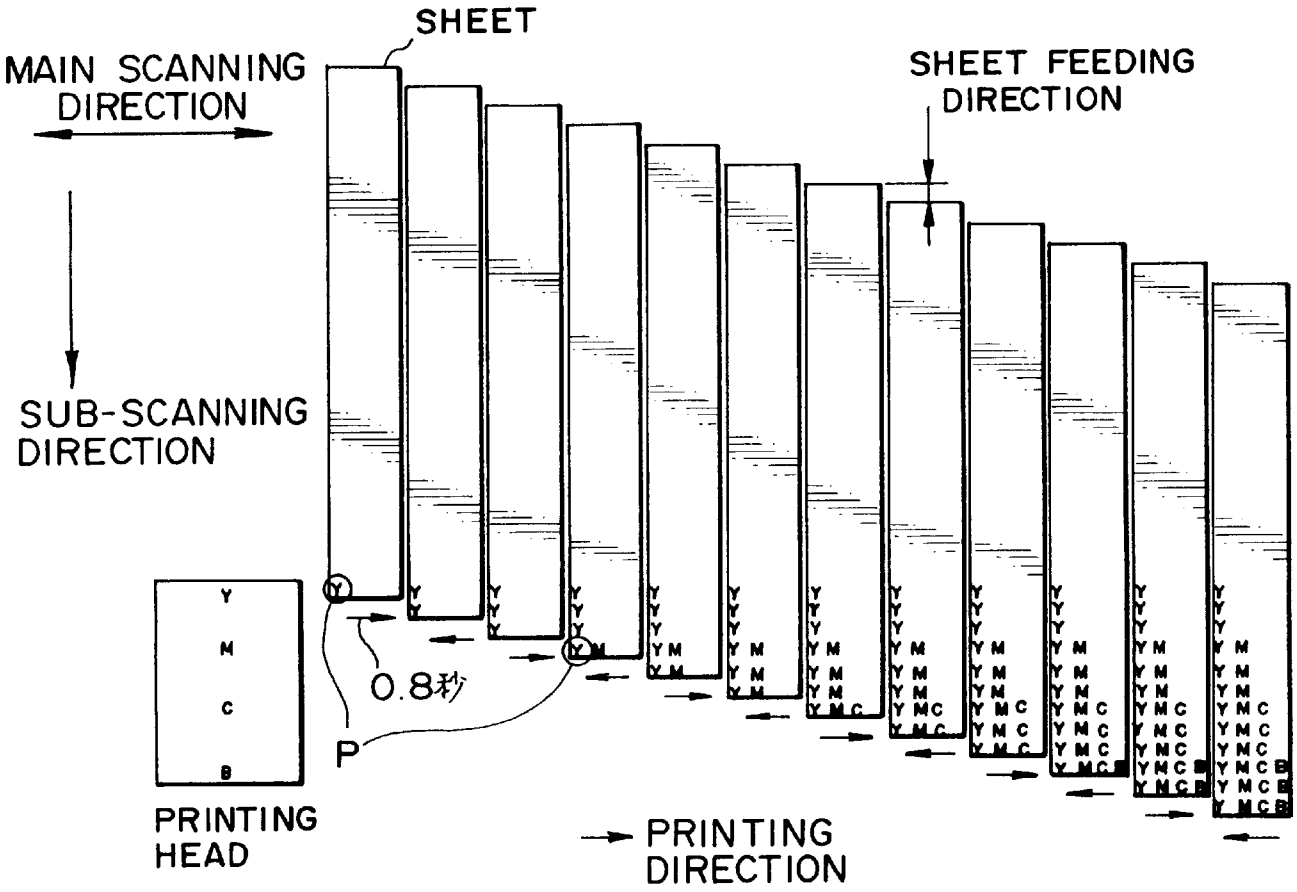
FIG. 13 is a schematic view showing how the inkjet printing head performs its printing operation.

With the present invention, the space between two adjacent nozzle rows, e.g. 16*a*–16*b*, is equal to two printing widths in the sub-scanning direction (refer to FIG. 5A). Therefore, there is a time interval corresponding to one back-and-forth motion of the printing head from a moment when a first color is printed at one position till a moment when a second color is applied onto the same position. FIG. 13 schematically shows how different colors are applied on one after another. To facilitate understanding, Y, M, C and BK are separately shown in the printing direction. In actual fact, they are put on one after another. After a color Y is printed at a position P, there is a time interval corresponding to one back-and-forth motion of the printing head until another ink color M is overlaid on the position P. It is assumed here that one forward motion takes 0.8 seconds and one backward motion also takes 0.8 seconds. It follows that there is a time interval of approximately 1.6 seconds+$\alpha$.

This time interval of approx. 1.6 seconds+$\alpha$ is sufficient time for the ink to dry. Second ink can be put on the first ink which is completely dried. No penetrant, which has been used in the prior art printer, is required for the ink used in the present invention. The printed image will not be blurred due to the ink penetrated into the sheet. The printer can produce high quality color images on any types of sheet such as coated sheets as well as plain sheets.

Printing data should be delayed depending upon a color to be printed since the space between the two adjacent nozzle rows corresponds to the two printing widths. The printing data can be easily delayed by controlling data output timing using a buffer memory. This can be accomplished without difficulty due to the sophisticated performance of the latest memory devices.

The pair of sheet holders 70 are located along the opposite side edges of the sheet S in the main scanning direction. Since the nozzle rows 16*a*–16*d* of the printing head 300 are arranged along the sub-scanning direction, the printing head 300 inevitably becomes wider in the sub-scanning direction. If it happens to be raised under the printing head 300, the sheet S may come into contact with the printing head 300 and be smeared with the ink. To prevent such a problem, the sheet holders 70 hold the sheet S so as not to be raised.

Further, since it is fed by the pair of rollers 80 and 82 and the pair of rollers 84 and 86, the sheet S can be color-printed over its entire area. In other words, these pairs of rollers are disposed respectively upstream and downstream of the inkjet printing head 300, so that they can reliably feed the sheet S. Specifically, only the pair of rollers 84, 86 feed the sheet S after its leading edge has reached the pair of rollers 80, 82. The roller 84 includes a plurality of split and knurled roller members 84*a* since they come into contact with the printed surface of the sheet S, as described previously. On the other hand, if it is fed by only one pair of rollers, the sheet S cannot be printed over its entire area because the nozzle rows are arranged in the sub-scanning direction.

The inkjet printing head 300 is manufactured as follows. When the head base plate 11 is made from a glass material, the ink channels are formed thereon by a glass-etching or abrasive blasting process. The ink channels are approximately 200 $\mu$m deep.

Through-holes are formed on the head base plate 11 at portions serving as nozzles 16*a*–16*d*2. The through-holes are made by using a laser such as an excimer laser, a pulse $CO_2$ laser, a $CO_2$ laser or a YAG laser, or using ultrasonic waves. The excimer laser or pulse $CO_2$ laser is effective to precisely shape the through-holes since they generate little heat. The ultrasonic waves are also effective to make the precise through-holes but are disadvantageous since they take time.

When the head base plate 11 is made from a glass material which is less water-repellent, a direction and an amount of ink to be ejected via the nozzles tend to become variable because of ink sticking on the surface where the nozzles are formed. Therefore, this problem is overcome using a nozzle plate which is made from resin or the like and can repel water efficiently. Such a nozzle plate is easily formed with holes whose diameter is accurately controlled. The nozzle plate is stuck onto an ink ejecting surface of the head base plate 11 such that the through-holes on the head base plate 11 and the holes on the nozzle plate are in agreement with one another, and function as the nozzles. In this case, the through-holes on the head base plate 11 are not required to be sized precisely. Thus, the through-holes are made larger than the nozzle diameter so as to reduce resistance applied to the ink channels and to facilitate the fabrication of the nozzles.

The base head plate 11 made from a resin material is suitable for the mass-production. The ink channels and nozzles can be molded using dies. Further, the resin material is relatively water-repellent. Therefore, different from the glass material, it is possible to form the nozzles, which have precise size, on the resin material using dies. Alternatively, the ink channels and most parts of the nozzles are made using the dies. The nozzles are then completed using excimer lasers.

The diaphragm 20 is fabricated as described hereinafter. When the head base plate 11 is made of glass, the diaphragm 20 is also made from glass. If the head base plate 11 is made from resin, the diaphragm 20 is also made from resin. The diaphragm 20 has the conductive film such as ITO or Cr on a surface opposite to the surface where the diaphragm 20 is in contact with the head base plate 11. The conductive film is applied by the vapor coating or sputtering process. The conductive film serves electrodes for the piezoelectric elements attached on the diaphragm 20. The piezoelectric elements 22*a*1–22*d*2 are connected not only to these electrodes but also to electrodes 34*a*1–34*d*2 formed on the flexible cable 30. Thus, a voltage is applied to the piezoelectric elements via these electrodes.

The piezoelectric elements 22*a*1–22*d*2 are attached on the diaphragm 20, as shown in FIGS. 6 and 7. The piezoelectric elements are fabricated as follows. First of all, a sheet of piezoelectric element material is stuck onto a dummy glass plate, which is then split in accordance with a pattern of the pressure chambers on the head base plate 11, using the abrasive blasting process or the like. The piezoelectric elements split on the dummy glass plate is transferred and stuck onto the diaphragm 20. Then the dummy glass plate will be removed.

The diaphragm 20 is then attached onto the head base plate 11. When made from glass, the diaphragm 20 is heated and fused to the head base plate 11. Alternatively, a glass layer having a low melting point is applied on the diaphragm 20 or the head base plate 11 using the sputtering or vapor coating process. Then, the diaphragm 20 and the head base plate 11 are stuck. On the other hand, if the head base plate 11 is made from resin, the diaphragm 20 is also made from resin. In this case, they are stuck each other using ultrasonic waves, heat, adhesive, or the like so as to constitute the base plate unit 10.

To prevent generation of unnecessary vibrations or noise, it is preferable that the flexible cable 30 and the diaphragm 20 are in intimate contact with each other except for the areas where the piezoelectric elements are present. For this purpose, an adhesive sheet is used to stick the flexible cable 30 onto the diaphragm 20. The adhesive sheet is cut away at portions corresponding to the piezoelectric elements. The adhesive sheet is preferably thicker than the piezoelectric elements so that vibrations generated at piezoelectric elements do not inversely affect the other portions of the diaphragm 20.

With the inkjet printing head of the invention, the nozzle rows are arranged in the sub-scanning direction, so that the printing head can have a reduced width in the main scanning direction. Further, the printing head does not scan an unnecessary space in the main scanning direction, it can reduce its printing period. Since the nozzle rows 16*a*–16*d* are relatively inclined in the sub-scanning direction, it is possible to overcome the problem that the nozzles cannot be densely juxtaposed when the piezoelectric elements are used. The inkjet printing head can use any types of ink and assure improved printing quality, since it can also use oil-based ink which is not suitable for the bubble jet type printing head. Further, the use of the piezoelectric elements enables the size of ink drops to be variable as desired by controlling a voltage to be applied and displacement of the piezoelectric elements. This allows printed images to be as clear and sharp as a photograph. Further, 60 nozzles are respectively used for each of the four colors so as to accelerate the printing operation. The printing head applicable to four colors is described above. Alternatively, it is also possible to provide inkjet printing heads applicable to three colors, or five or more colors.

What is claimed is:

1. An inkjet printing head in which piezoelectric elements are flexed by a drive voltage applied thereto and cause a diaphragm, where the piezoelectric elements are disposed to, to shudder so as to eject ink through nozzles, the inkjet printing head comprising:

(a) a plurality of nozzles arranged in a plurality of rows on a head base plate, each of the nozzle rows being arranged in an inclined manner along a sub-scanning direction where a printing medium is moved, and each of the nozzle rows being spaced apart from an adjacent nozzle row by a distance which is at least twice a printing width; and (b) a plurality of pressure chambers disposed on the head base plate, the pressure chambers being in communication with the nozzles, changing capacity in response to shudders of the diaphragm, and being arranged in two rows along the sub-scanning direction, in a vicinity of each nozzle row.

2. The inkjet printing head as in claim 1, wherein four nozzle rows are arranged along the sub-scanning direction.

3. The inkjet printing head as in claim 1 further comprising a flexible cable which has a plurality of discrete electrodes corresponding to the piezoelectric elements on a one-to-one basis so as to apply a voltage to the piezoelectric elements, and lead wires from the discrete electrodes, wherein the lead wires are disposed along the right and left side edges of the flexible cable.

4. The inkjet printing head as in claim 3, wherein the flexible cable has reinforcing electrodes serving for common electrodes disposed along a main scanning direction in which the inkjet printing head moves.

5. The inkjet printing head as in claim 3 further comprising a frame for fixing the flexible cable, the frame including a portion for pressing the flexible cable toward the diaphragm at positions except for where the piezoelectric elements are disposed.

6. The inkjet printing head as in claim 1 further comprising ink supply means and ink retainers; wherein the ink supply means are in communication with the ink retainers and the pressure chambers so as to supply ink to the pressure chambers, in communication with the nozzles, through a plurality of supply routes.

7. An inkjet printer including an inkjet printing head in which piezoelectric elements are flexed by a drive voltage applied thereto and cause a diaphragm, where the piezoelectric elements are disposed to, to shudder so as to eject ink through nozzles, the inkjet printing head comprising:

(a) a plurality of nozzles arranged in a plurality of rows on a head base plate, each of the nozzle rows being arranged in an inclined manner along a sub-scanning direction where a printing medium is moved, and each of the nozzle rows being spaced apart from an adjacent nozzle row by a distance which is at least twice a printing width; and (b) a plurality of pressure chambers disposed on the head base plate, the pressure chambers being in communication with the nozzles, changing capacity in response to shudders of the diaphragm, and being arranged two rows along the sub-scanning direction, in a vicinity of each nozzle row.

8. The inkjet printer as in claim 7, comprising a sheet feeding mechanism for feeding a printing medium relative to the inkjet printing head, the sheet feeding mechanism including a plurality of feed rollers disposed upstream and downstream of the inkjet printing head.

9. The inkjet printer as in claim 7, wherein one of the feed rollers downstream of the inkjet printing head has a plurality of split and knurled roller members.

10. The inkjet printer as in claim 7 further comprising sheet holders for holding and feeding the printing medium over a printing medium feeding area.

11. The inkjet printer as in claim 10, wherein the sheet holders hold opposite side edges of the printing medium with respect to a main scanning direction of the inkjet printing head.

* * * * *